US010914554B2

(12) United States Patent
Komulainen

(10) Patent No.: US 10,914,554 B2
(45) Date of Patent: Feb. 9, 2021

(54) DEVICE FOR SUPPORTING A FIREARM

(71) Applicant: Jouko Komulainen, Kello (FI)

(72) Inventor: Jouko Komulainen, Kello (FI)

( * ) Notice: Subject to any disclaimer, the term of this patent is extended or adjusted under 35 U.S.C. 154(b) by 0 days.

(21) Appl. No.: 16/589,632

(22) Filed: Oct. 1, 2019

(65) Prior Publication Data

US 2020/0109919 A1 Apr. 9, 2020

(51) Int. Cl.
*F41G 11/00* (2006.01)

(52) U.S. Cl.
CPC ..... *F41G 11/005* (2013.01)

(58) Field of Classification Search
CPC ..... F41A 23/16; F41A 23/18; F41A 35/00; F41A 23/00; F41G 11/005; F41G 11/003
USPC ..... 42/124, 94
See application file for complete search history.

(56) References Cited

U.S. PATENT DOCUMENTS

| | | | | |
|---|---|---|---|---|
| 7,100,318 | B1 * | 9/2006 | Beltz | F41A 23/06 248/274.1 |
| 8,943,730 | B2 * | 2/2015 | Ascano | F41C 33/007 42/94 |
| 10,184,747 | B1 * | 1/2019 | Courter | B60R 7/14 |
| 10,197,358 | B2 * | 2/2019 | Hebden | F41C 23/22 |
| 10,309,752 | B1 * | 6/2019 | Britt | F41G 11/003 |
| 2004/0000083 | A1 * | 1/2004 | Grant, Jr. | F41G 11/003 42/112 |
| 2004/0068911 | A1 * | 4/2004 | Schurtenberger | F41A 23/02 42/94 |
| 2005/0115140 | A1 * | 6/2005 | Little | F41A 23/02 42/118 |
| 2009/0101776 | A1 * | 4/2009 | Peterson | F41G 11/001 248/205.1 |
| 2010/0236126 | A1 * | 9/2010 | Johnson | F41A 23/16 42/94 |
| 2011/0076095 | A1 * | 3/2011 | Storch | F41C 27/00 403/322.4 |
| 2018/0328696 | A1 * | 11/2018 | Senn | F41G 1/545 |
| 2019/0128470 | A1 * | 5/2019 | Johnson, Sr. | F41G 11/00 |

OTHER PUBLICATIONS

ACD Level—Anti-Cant Device for Long Range Shooting; https://www.youtube.com/watch?v=68i66NhpsSM; (Year: 2013).*

* cited by examiner

*Primary Examiner* — Joshua E Freeman
(74) *Attorney, Agent, or Firm* — Jacob Eisenberg

(57) ABSTRACT

The invention is a device for supporting a firearm. The device comprises a body, a gripping arrangement, a fixing arrangement for the gripping arrangement and a holding arrangement for fixing the body onto the scope rail of the firearm. The body has an upper surface and a bottom surface and a first side and a second side, and on the bottom surface is a rail channel. The walls of the rail channel are configured in such a way that at least part of the scope rail can be fitted into the rail channel, and the fixing arrangement for the gripping arrangement is configured to fix the gripping arrangement into a first position where the gripping arrangement extend from the first side of the body. The first end of the gripping arrangement is configured to grip a surface when supporting the firearm.

16 Claims, 4 Drawing Sheets

DEVICE FOR SUPPORTING A FIREARM

FIELD OF INVENTION

The invention relates to a device for supporting a firearm, the firearm comprising a scope rail on the upper side of the firearm, and the scope rail is an elongated continuous body parallel to the longitude axis of the firearm and the width of the upper surface of the scope rail is larger than a width of the scope rail at least somewhere between the upper side of the firearm and the upper surface of the scope rail.

BACKGROUND OF THE INVENTION

It is a well-known fact that when using a long-barrelled firearm, such as a rifle or a shotgun, aiming when standing is not always an easy task. The firearm is heavy, and it may take some time to stabilize it. Of course, this can cause considerable problems when hunting where targeting should be fast and accurate. Also, waiting in a shooting position is exhausting and thus aiming can be difficult.

It is common that legs and tripods may be attached to a firearm to support and hold it in position. Also, there are many kinds of structures which can be used when trying to stabilize a firearm. Patent publication U.S. Pat. No. 4,026,057 discloses a shooting support for a rifle. However, this is a quite complicated construct, and it is almost impossible to use in rough terrain, for example in wooded area. Patent publication US20100236126 discloses a support apparatus where a rifle is suspended from a quite complex frame structure.

BRIEF SUMMARY OF THE INVENTION

The object of the invention is a solution that can significantly reduce the disadvantages and drawbacks of the prior art. In particular, the object of the invention is a solution where a device is provided that allows support when shooting with a firearm.

The objects of the invention are attained with an arrangement that is characterised by what is stated in the independent patent claim. Some advantageous embodiments of the invention are disclosed in the dependent claims.

In the invention is a device that is attachable to a scope rail on a firearm. The device comprises a body and a gripping element. The gripping element is pushed against a surface such as a trunk of a tree to support the firearm.

When reference is made in the text to the upper or the lower parts or respective directions such as down or up, a situation is described in which the device according to the invention is resting on a surface in a similar position when it is attached to a firearm. Also, when reference is made to the vertical or horizontal directions or surfaces, the device is placed similarly.

In one embodiment of the invention is a device for supporting a firearm, the firearm comprising a scope rail on the upper side of the firearm, and the scope rail is an elongated continuous body parallel to the longitude axis of the firearm and the width of the upper surface of the scope rail is larger than a width of the scope rail at least somewhere between the upper side of the firearm and the upper surface of the scope rail. In one advantageous embodiment of the invention, the device comprises a body, a gripping arrangement, a fixing arrangement for the gripping arrangement and a holding arrangement for fixing the body to the scope rail. The gripping arrangement has a first end and a second end, the body has an upper surface and a bottom surface and a first side and a second side, and on the bottom surface is a rail channel. The walls of the rail channel are configured in such a way that at least part of the scope rail can be fitted into the rail channel, and the fixing arrangement for the gripping arrangement is configured to fix the gripping arrangement into a first position where the gripping arrangement extends from the first side of the body. The first end of the gripping arrangement is configured to grip a surface when supporting the firearm.

In one embodiment of the device, the gripping arrangement in the first position is perpendicular to the longitudinal axis of the firearm. This feature makes the supporting procedure fast because the user of the device does not need to seek a good position. Also, it allows moving the direction of the firearm.

In a second embodiment of the device, the gripping arrangement is configured to be rotatable to a second position where the gripping arrangement is parallel to the first side. This feature increases safety and makes it possible to transfer the firearm without the need to detach the device.

In a third embodiment of the device, the fixing arrangement for the gripping arrangement is near the first side and the gripping arrangement is configured to be rotatable in relation to the fixing arrangement.

In a fourth embodiment of the device, on the second end of the gripping arrangement is a slot, and in the slot is a elastic element, for example a spring, and the slot has a first end and a second end, and the second end of the slot is near the second end of the gripping arrangement, and the fixing arrangement for the gripping arrangement is in the slot, and the gripping arrangement is configured to be movable in the longitudinal direction of the gripping arrangement and during these movements the elastic element is configured to compress and uncompress. This feature improves the gripping arrangement turning process.

In a fifth embodiment of the device, the body comprises a cavity and in the first position the second end of the gripping arrangement is configured to be in the cavity. This feature improves stability in the first position.

In a sixth embodiment of the device, the body comprises a gripping arrangement cavity on the first side, and on the second position the gripping arrangement is configured to be at least partly in the gripping arrangement cavity. This feature further improves the safety and the mobility of the firearm when fitted with the device.

In a seventh embodiment of the device, the gripping arrangement cavity is configured in such a way that when the elastic element is uncompressed, the gripping arrangement is locked into the second position, and the gripping arrangement is movable to the first position when the elastic element is compressed sufficiently. This feature further improves the safety of the device.

In an eight embodiment of the device, the body comprise two parts; a first body part and a second body part, and the first side is on the first body part and the second side is on the second body part and the rail channel is divided into two parts, and one part of the rail channel is on the first body part and another part of the rail channel is on the second body part, and the holding arrangement is configured to keep the body parts together and let them be separated. This feature allows fast attaching and detaching of the device.

In a ninth embodiment of the device, there is a first body part position and a second body part position, and the rail channel has an opening and in the first body part position the width of the opening is less than the width of the scope rail and in the second body part position the width of the opening is more than the width of the scope rail.

In a tenth embodiment of the device, the holding arrangement comprises a holding arrangement with an elastic body part, for example one or more springs, and the holding arrangement with the elastic body part is configured to compress and uncompress, and when it is uncompressed the body parts are in the first body part position, and when it is compressed sufficiently the body parts are in the second body part position.

In an eleventh embodiment of the device, the holding arrangement comprises at least two bolt elements: a first bolt element and a second bolt element, and the gripping arrangement is between the bolt elements. This feature prevents torque forces in the device.

In a twelfth embodiment of the device, the gripping arrangement is detachable, and the body is configured in a such way that the gripping arrangement can be fixed to extend from the second side of the body. This feature increases the usability of the device.

In a thirteenth embodiment, the device is configured to be fixed onto the scope rail in two positions: a first position where the first side is on the right side of the firearm and a second position where the first side is on the left side of the firearm. This feature increases the usability of the device.

In a fourteenth embodiment of the device according to the invention, the first end of the gripping arrangement is turned downwards and sharpened. This feature improves the gripping capability of the device.

It is an advantage of the invention that it provides a device that is easy to use for supporting a firearm. Using the device significally improves the stability of the shooting procedure. It also produces a device that is suitable for many kinds of firearms, because the scope rail that the device is designed for, is quite common, especially on hunting firearms.

One advantage of the invention is that it is fast to use. The device can also be easily and quickly assembled and disassembled.

It is a further advantage of the invention that it is safe to use and is suitable for outdoor use.

BRIEF DESCRIPTION OF THE SEVERAL VIEWS OF THE DRAWINGS

In the following, the invention is described in detail. The description refers to the accompanying drawings, in which.

DETAILED DESCRIPTIONS OF THE INVENTION

The embodiments in the following description are given as examples only and someone skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1A:
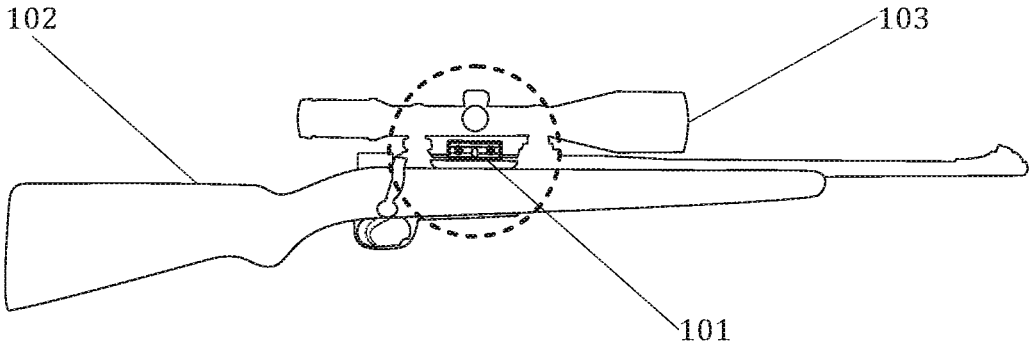
FIG. 1*a* shows an example of a firearm where a device in accordance with an embodiment is attached.
Figure 1B:
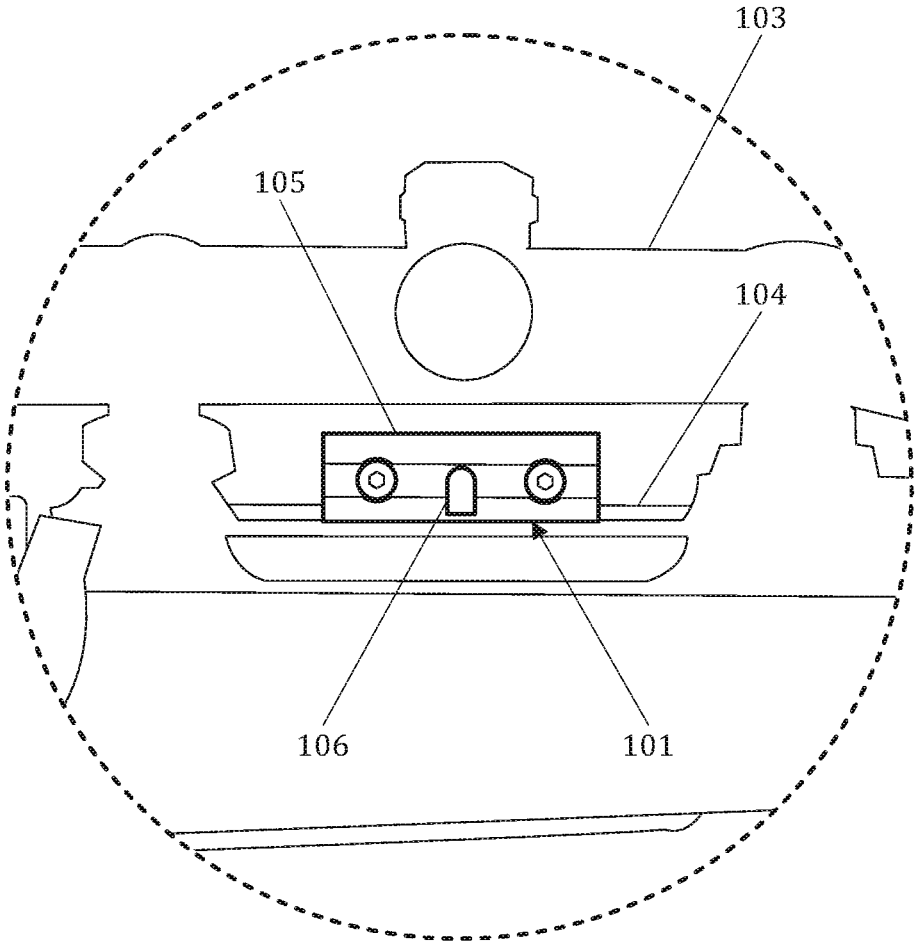
FIG. 1*b* shows an enlarged area of the firearm presented in FIG. 1*a*.

FIGS. 1*a* and 1*b* shows an example of a device 101 when it is placed on a firearm 102. In this example the firearm is a rifle. On the firearm is a scope 103 which is attached to a scope rail 104. The scope rail is an elongated continuous body parallel to the longitude axis of the rifle. The device is also attached to the scope rail. It must be noted that the scope rail can be used for other accessories, for example distance detectors, laser pointers and such. The device comprises a body 105 and a gripping arrangement 106. In the body are means for fixing the device on the scope rail. The gripping arrangement extends from the side of the body and it is essentially perpendicular to the scope rail.

When the user of the firearm 102 wants to stabilize the firearm, for example when aiming, he or she lifts the firearm to the aiming position and pushes the gripping arrangement 106 against a surface such as, for example, a tree or a wooden pole. The side to which the gripping arrangement extends can be chosen by the user. The point of the gripping arrangement grips the surface and supports the firearm. Because the scope rail 104 is in this example in the middle part of the firearm, the user can move the firearm while keeping the gripping arrangement as a pivot point and change the aiming direction without moving the firearm. In some embodiments, the device is positioned as closely as possible to the centre of the gravity of the firearm. In some embodiments, this close area is 30% of the total length of the firearm, i.e. the distance from the vertical line of the centre of the gravity is 15% of the total length of the firearm in both directions.

Figure 2A:
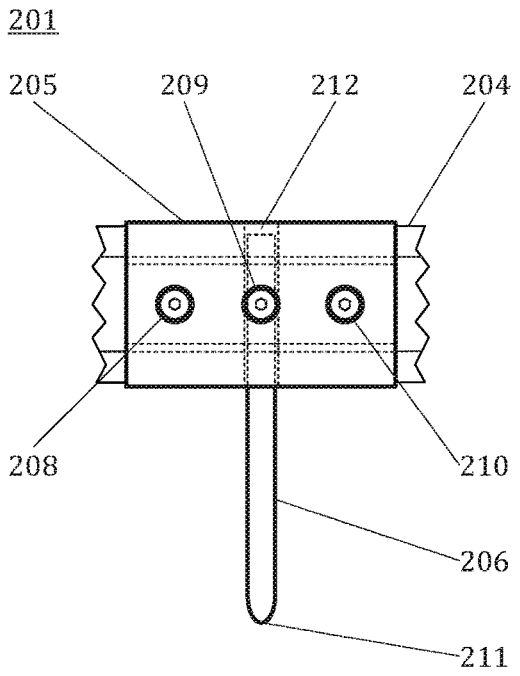
FIG. 2*a* shows a second example of a device according to an embodiment as seen from above.
Figure 2B:
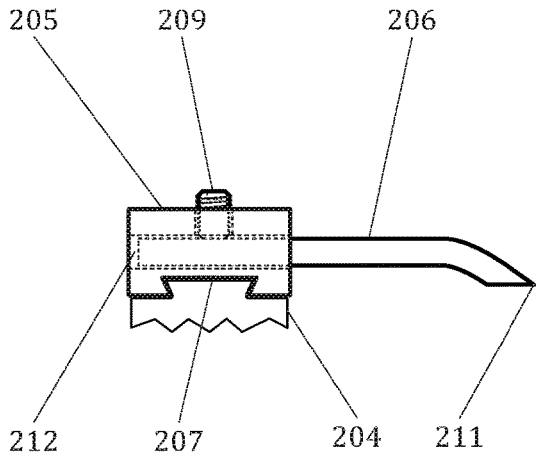
FIG. 2*b* shows the device presented in FIG. 2*a* as seen from side.

In FIG. 2*a*, the device 201 is seen from above. In FIG. 2*b*, it is seen from the side. The device comprises a body 205, a gripping arrangement 206, a fixing arrangement 209 for the gripping arrangement and a holding arrangement, which comprises two holding means: a first holding means 208 and a second holding means 210. In some embodiments the holding means can be bolt elements. The device is configured to be placed on a scope rail 204.

The body 205 has a first end, a second end, a first side and a second side. The body also has an upper surface and a bottom surface. The body is placed on the scope rail 204 in such a way that the first end is towards the barrel end of the firearm and the second end is towards the buttstock of the firearm. The bottom surface is on the scope rail. In this example, the body is a rectangular shape, but naturally other forms can be used. The body is advantageously made of some metal or alloy, but other materials can be used, such as, for example, composites.

In the body 205, is a tunnel or cavity 212 for the gripping arrangement 206. The tunnel is a holding cavity for the gripping arrangement. The holding cavity is shaped similarly to the gripping arrangement. In this example, the gripping arrangement is an elongated spike. It is held in place in the holding cavity by the fixing arrangement 209 for the gripping arrangement. The gripping arrangement extends perpendicularly from the first side. The gripping arrangement has a first end 211 and a second end. The first end of gripping arrangement is sharpened and bent. The arrangement is positioned in such a way that the bent first end points downwards when the device is in use. Naturally, the gripping arrangement can be implemented in many different ways. The position of the gripping arrangement can be changed in the tunnel (i.e. the holding cavity). The fixing arrangement 209 for the gripping arrangement is used for holding the gripping arrangement in place. The fixing arrangement can be, for example, a screw arrangement or similar. The gripping arrangement can also be separated from the body 205. For example, this can be done when the gripping arrangement has to be changed or when the firearm equipped with the device is transported. In some embodiments, the gripping arrangement and the tunnel are configured in such a way that the gripping arrangement can be positioned inside the tunnel from either opening, i.e. from the first side or the second side. In this way, the side from which the firearm is supported can be changed. There are also embodiments in which the same effect can be achieved by turning the whole device in such a way that the second end of the body will be towards the barrel end of the firearm.

The scope rail 204 is an elongated continuous body parallel to the longitude axis of the firearm. The width of the upper surface of the scope rail is larger than the width of the scope rail at least somewhere between the upper side of the rifle and the upper surface of the scope rail. The cross-cut of the scope rail is therefore a simple fish-tail structure. On the bottom surface of the body 205 is a rail channel 207. The walls of the rail channel (i.e. the cross-cut of the rail channel) are configured in such a way that at least part of the scope rail can be fitted in the rail channel. The scope rails are generally designed in such a way that accessories, such as the device 201 according the invention, can be slid onto the scope rail from either end of the scope rail. When the device is in the desired position on the scope rail, the holding arrangement is used for anchoring the device.

Figure 3:
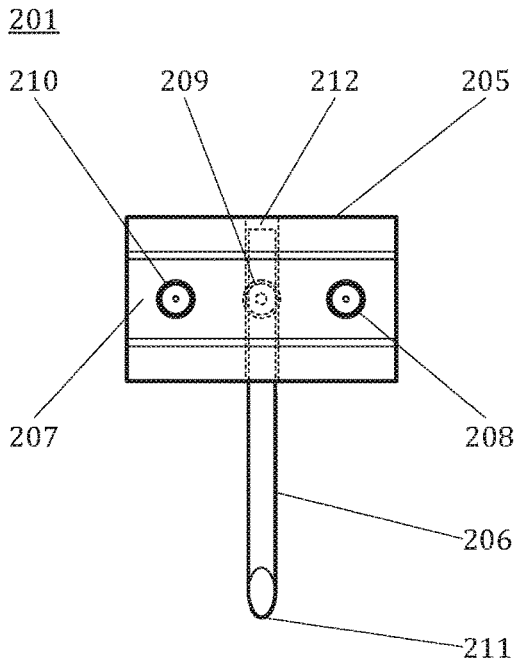
FIG. 3 shows the device presented in FIG. 2*a* as seen from below.

In FIG. 3, the device 201 is seen from below, i.e. from the direction of the bottom surface. The rail channel 207 is formed on the bottom surface and it extends from the first end of the body to the second end of the body. Advantageously, the rail channel is parallel to the sides of the body. The rail channel is configured to receive at least part of the scope rail in a horizontal direction. In use, the device is positioned in such a way that the scope rail extends over the rail channel. The holding arrangement comprises two holding means: the first holding means 208 and the second holding means 210. The first holding means and the second holding means extend from the upper surface of the body 205 into the rail channel. The holding means are situated in such a way that the gripping arrangement 206 or the holding cavity 212 of the gripping arrangement is between the holding means. The holding means are in this embodiment configured to push the body upwards to press the side walls of the rail channel against the sides of the scope rail.

Figure 4A:
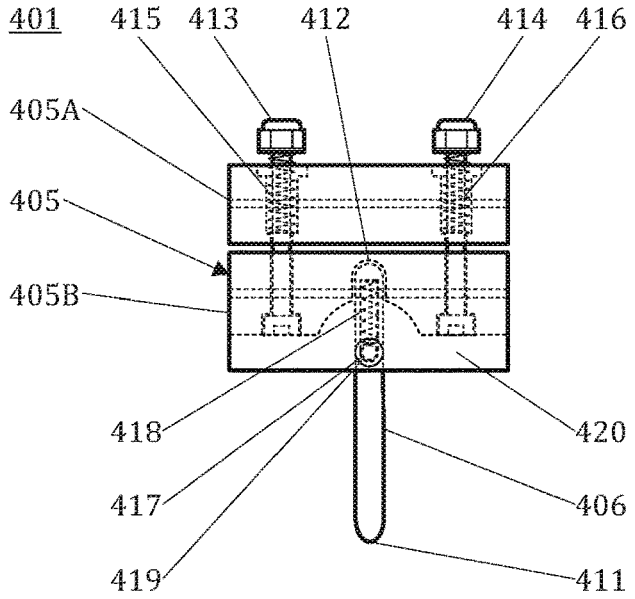
FIG. 4*a* shows a third example of a device according to an embodiment as seen from above.
Figure 4B:
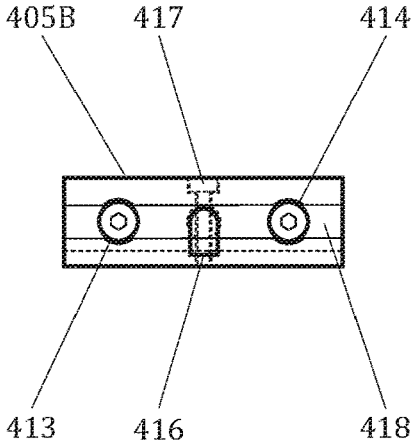
FIG. 4*b* shows the device presented in FIG. 4*a* as seen from side.

FIG. 4 shows a third embodiment of the device 401. In FIG. 4*a*, the device is seen from above. In FIG. 4*b*, it is seen from the side. The device comprises a body 405, a gripping arrangement 406, a fixing arrangement 417 for the gripping arrangement and a holding arrangement, which comprises two holding means: a first holding means 413 and a second holding means 414.

In this embodiment the body 405 comprises two parts: a first body part 405B and a second body part 405A. The body 405 has a first end, a second end, a first side and a second side. The body also has an upper surface and a bottom surface. On the bottom surface is a rail channel for receiving the scope rail of the firearm that is to be supported by the device 401. The body parts divide the rail channel, i.e. one part of the rail channel is in the first body part and another part of the rail channel is in the second body part. Advantageously, the seam between the body parts on the surface of the rail channel is parallel to the longitudinal axis of the scope rail. The rail channel parts on the first body part and the second body part do not need to be mirror images but they can be different in shape and size.

On the first body part 405B is the gripping arrangement 406. The gripping arrangement is an elongated structure which have a first end 411 and a second end. The gripping arrangement is fixed to the body, and more particularly to the first body part, with the fixing arrangement 417 for the gripping arrangement. In this embodiment, there is a slot 419 near the second end of the gripping arrangement. The fixing arrangement is inside the slot. There is also an elastic element 418 inside the slot. The fixing arrangement and the elastic element are configured in a such way that the gripping arrangement is movable in relation to the fixing arrangement (and the body 405). The elastic element is a spring or similar arrangement which tries to assume its original shape when compressed. One end of the elastic element is fixed to the fixing arrangement and another end to the gripping arrangement (i.e. one end of the slot). The gripping arrangement can be pulled in a longitudinal direction and the elastic element compresses. When the gripping arrangement is released, i.e. the pulling force is removed, the elastic element uncompresses and tries to push the gripping arrangement to the initial position. The first body part also comprises a gripping arrangement cavity 420 and a tunnel 412. When the device 401 is ready to support the firearm it is attached to, the gripping arrangement is perpendicular to the device and to the longitudinal axis of the scope rail (a gripping position). The gripping arrangement recess is a groove-like structure on the first side of the body (i.e. on the first body part). In this embodiment, it extends from the first end of the body to the second end of the body. The tunnel is situated on the wall of the gripping arrangement cavity. The tunnel is shaped and situated in such a way that the second end of the gripping arrangement fits into the tunnel when the gripping arrangement is in the gripping position. Because the elastic element keeps the second end of the gripping arrangement in the tunnel, it can move only in the longitudinal direction, away from the body. If the second end of the gripping arrangement is pulled out of the tunnel, the gripping arrangement can be rotated in the gripping arrangement cavity around the fixing arrangement. In some embodiments, the gripping arrangement is rotatable into a position where the gripping arrangement is at least partly inside the gripping arrangement cavity. In some embodiments, moving of the gripping element is implemented without the elastic element fitted inside the slot. Also, there are embodiments where no slot is needed, but the elastic element is, for example, around the gripping element. Also, in some embodiment the movements of the gripping arrangement can be implemented without elastic elements.

The first holding means 413 and the second holding means 414 hold the first body part 405B and the second body part 405A together. The holding means can, for example, be bolt arrangements, which are placed in a horizontal direction. There are holes for the holding means from the second side of the body to the first side of the body. In the ends of the holding means there are structures that prevent the holding means from sliding through the holes. In this example, holes reach into the first body part the wall of the gripping arrangement recess. In this example, the holding means are parallel to the gripping arrangement 406 in the gripping position. The first holding means comprises a first holding arrangement elastic arrangement 415 and the second holding means comprises a second holding arrangement elastic arrangement 416. The holding arrangement elastic arrangement can be, for example, springs that coil around the holding arrangements and one end of the elastic arrangement is fixed to the holding arrangement and another end is fixed to the body (the second body part). The elastic arrangements have uncompressed and compressed positions. The elastic arrangements are configured in a such way that in the uncompressed position they push the first body part and the second body part together. The first body part and the second body part can be pulled apart and the elastic arrangements are in the compressed position, and the gap between the body parts is larger than in the uncompressed position. When the pulling is ended, the elastic arrangements return to the uncompressed position. This makes it possible to widen the rail channel and thus the device 401 can be fitted onto the scope rail without sliding the device from either end of the scope rail. In some embodiments, the holding arrangement elastic arrangements are implemented with magnets.

Figure 5:
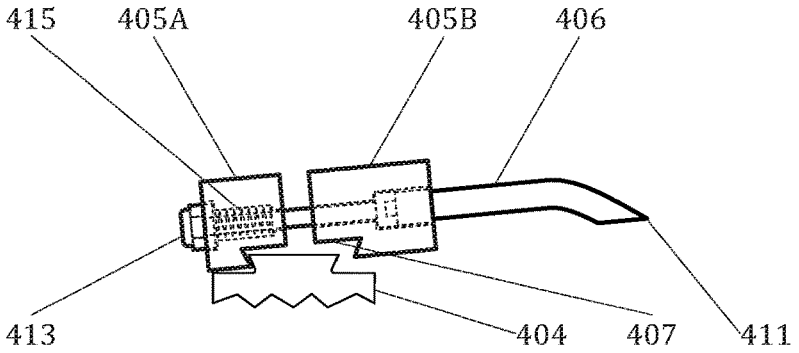
FIG. 5 shows the device presented in FIG. 4*a* as seen from side, when the device is placed on the firearm.

In FIG. 5, is shown the device 401 presented in FIGS. 4A and 4B. In this figure, the device is seen from the direction of the second end of the body, i.e. along the scope rail 404. There is a rail channel 407 on the bottom surface of the body. In this example, the device is in the process of being attached onto the scope rail. There is a gap between the first body part 405B and the second body part 405A, and the holding arrangement elastic arrangements 415 are in the compressed position. The opening of the rail channel 407 is wider than the width of the top surface of the scope rail. In that case the first body part can be lowered into a position where the walls of the rail channel surround the scope rail.

Figure 6:
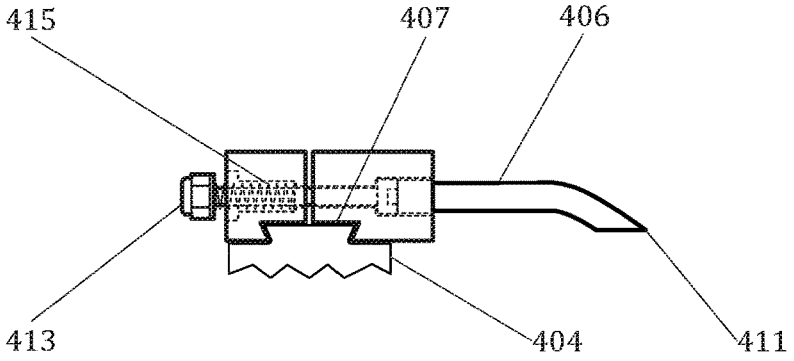
FIG. 6 shows the device presented in FIG. 4*a* as seen from side, when the device is in place.

In FIG. 6 the device 401 is seen from the same direction as in FIG. 5. The holding arrangement with the elastic part 415 are in the uncompressed position and they pull the first body part and the second body part together and squeeze the scope rail 404 between them, thus fixing the device into place for supporting the firearm. In some embodiments, there are some additional holding arrangements in a vertical position run from the upper surface to the bottom surface of the body.

Figure 7A:
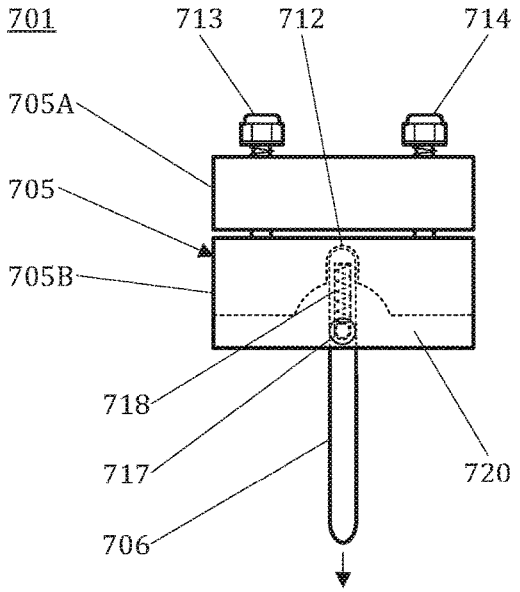
FIG. 7*a* shows a fourth example of a device according to an embodiment as seen from above.
Figure 7B:
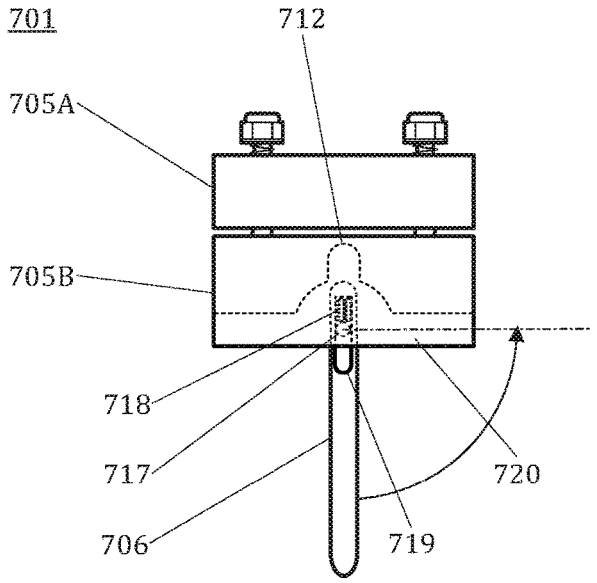
FIG. 7*b* shows the device presented in FIG. 7*a*, when the gripping arrangement is turned.
Figure 8A:
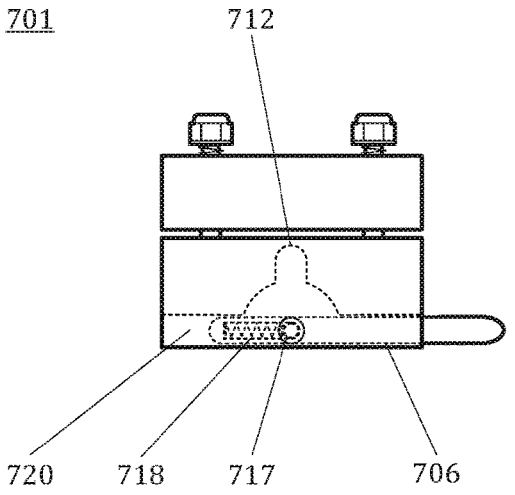
FIG. 8*a* shows the device presented in FIG. 7*a*, when the gripping arrangement is in the side position.
Figure 8B:
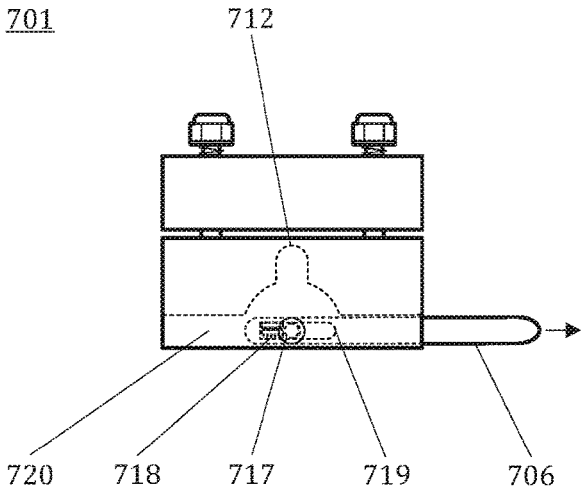
FIG. 8*b* shows the device presented in FIG. 7*a*, when the gripping arrangement is turned to the gripping position.

In some embodiments of the invention, the gripping arrangement is rotatable from a first position (the gripping position) to a second position and back. One example is shown in FIGS. 7 and 8. FIGS. 7A and 7B show the first position and FIGS. 8A and 8B show the second position. Also, the figures describe how the gripping arrangement is moved between said positions.

FIGS. 7 and 8 show a device 701 as seen from above. The device comprises a body 705, a gripping arrangement 706, a fixing arrangement 717 for the gripping arrangement and a holding arrangement, which comprises two holding means: a first holding means 713 and a second holding means 714. A rail channel is on the other side of the device and is not seen in these figures. The body has a first end and a second end and a first side and a second side.

In this embodiment, the body 705 comprises two parts: a first body part 705B and a second body part 705A. A gripping arrangement cavity 720 and a tunnel 712 are on the first body part. The gripping arrangement 706 has a first end and a second end. On the second end of the gripping arrangement is a slot 719. The gripping arrangement is fixed to the body, and more particularly to the first body part, with the fixing arrangement 417 for the gripping arrangement. In this embodiment, there is a slot 719 near the second end of the gripping arrangement. The fixing arrangement is in the slot. There is also an elastic element 718 in the slot.

In the first position (FIG. 7A), the second end of the gripping arrangement 706 is on the tunnel 712. The elastic element 718, a spring for example, in the slot 719 pushes the gripping arrangement towards the end of the tunnel. The walls of the tunnel keep the gripping arrangement in position and the device can be used for supporting the firearm. The tunnel is situated on the wall of the gripping arrangement cavity 720. The gripping arrangement can be pulled in the longitudinal direction of the gripping arrangement in such a way that the second end of the gripping arrangement exits from the tunnel (FIG. 7B). The walls of the gripping arrangement cavity are shaped in such a way that when the second end of the gripping arrangement is out of the tunnel, the gripping arrangement can be rotated while keeping the fixing arrangement 717 as a pivot point. In FIG. 7B, the gripping arrangement is rotated to the second position. In this example, the gripping arrangement is turned towards the first end of the body. The elastic element is compressed during rotation. The second end is towards the wall of the gripping arrangement cavity. When the gripping arrangement reaches the second position, the wall of the gripping arrangement cavity is configured in such a way that the elastic element can uncompress and push the gripping arrangement inward.

In the second position (FIG. 8A), the gripping arrangement 706 is perpendicular to the first position. The gripping arrangement is partly in the gripping arrangement cavity 720. The first end of the gripping arrangement is in this embodiment outside of the body. In some embodiments, the gripping arrangement is in the second position entirely inside the gripping arrangement cavity. In that case, there is some auxiliary arrangement for moving the gripping arrangement from the second position to the first position. In the second position, the firearm with the device 701 may be transported or handled safely without accidentally gripping the device.

When the gripping arrangement 706 is in the second position (FIG. 8A), one side of the second end of the gripping arrangement is supported by the wall of the gripping arrangement cavity 720. This wall prevents rotation of the gripping arrangement without uncompressing the elastic element 718, i.e. moving the second end of the gripping arrangement into a position where it has room for rotating as was illustrated in FIG. 8B. This is achieved by pulling the gripping arrangement in the longitudinal direction. When the side of the second end of the gripping arrangement is no longer obstructed by the wall of the gripping arrangement cavity, the gripping arrangement can be rotated toward the first position (FIG. 7A).

It must be noted that the gripping arrangement and the body can be implemented in many different ways in order to attain a first and a second position for the gripping arrangement.

Some advantageous embodiments of the method and device according to the invention have been described above. The invention is however not limited to the embodiments described above, but the inventive idea can be applied in numerous ways within the scope of the claims.

The invention claimed is:

1. A device for supporting a firearm, the firearm comprising a scope rail on an upper side of the firearm, and the scope rail comprises an elongated continuous body parallel to a longitude axis of the firearm and a width of an upper surface of the scope rail is larger than a width of the scope rail at least somewhere between the upper side of the firearm and the upper surface of the scope rail, and the device comprises a body, a gripping arrangement, a fixing arrangement for the gripping arrangement and a holding arrangement for fixing the body to the scope rail, and the gripping arrangement has a first end and a second end, the body has an upper surface and a bottom surface and a first side and a second side, and on the bottom surface is a rail channel, and walls of the rail channel are configured such that at least part of the scope rail can be fitted into the rail channel, characterised in that the fixing arrangement for the gripping arrangement is configured to fix the gripping arrangement to a first position where the gripping arrangement extends from the first side of the body, the first end of the gripping arrangement is configured to grip a surface when supporting the firearm, and wherein the first end of the gripping arrangement is bent downwards and sharpened.

2. The device according to claim 1, characterised in that the gripping arrangement in the first position is perpendicular to the longitudinal axis of the firearm.

3. The device according to claim 2, characterised in that the body comprises a gripping arrangement cavity on the first side, and on the second position the gripping arrangement is configured to be at least partly in the gripping arrangement cavity.

4. The device according to claim 3, characterised in that the gripping arrangement cavity is configured in such a way that when an elastic element is uncompressed, the gripping arrangement is locked into the second position, and the gripping arrangement is movable to the first position when the elastic element is compressed sufficiently.

5. The device according to claim 1, characterised in that the gripping arrangement is configured to be rotatable to a second position where the gripping arrangement is parallel to the first side.

6. The device according to claim 1, characterised in that the fixing arrangement for the gripping arrangement is near the first side and the gripping arrangement is configured to be rotatable in relation to the fixing arrangement.

7. The device according to claim 6, characterised in that on the second end of the gripping arrangement is a slot, and in the slot is an elastic element, and the slot has a first end and a second end, and the second end of the slot is near the second end of the gripping arrangement, and the fixing arrangement for the gripping arrangement is in the slot, and the gripping arrangement is configured to be movable in the longitudinal direction of the gripping arrangement and during these movements the elastic element is configured to compress and uncompress.

8. The device according to claim 7, wherein the elastic element is a spring.

9. The device according to claim 1, characterised in that the body comprises a cavity and in the first position the second end of the gripping arrangement is configured to be in the cavity.

10. The device according to claim 1, characterised in that the body comprise two parts; a first body part and a second body part, and the first side is on the first body part and the second side is on the second body part and the rail channel is divided into two parts, and one part of the rail channel is on the first body part and another part of the rail channel is on the second body part, and the holding arrangement is configured to keep the body parts together and let them be pulled apart.

11. The device according to claim 10, characterised in that there is a first body part position and a second body part position, and the rail channel has an opening and in the first body part position the width of the opening is less than the width of the scope rail and in the second body part position the width of the opening is more than the width of the scope rail.

12. The device according to claim 11, characterised in that the holding arrangement comprises a holding arrangement with elastic parts, and the holding arrangement with elastic parts is configured to be uncompressed and compressed, and when uncompressed the body parts are in the first body part position, and when compressed sufficiently the body parts are in the second body part position.

13. The device according to claim 12, wherein the elastic parts comprise one or more springs.

14. The device according to claim 1, characterised in that the holding arrangement comprises at least two bolt elements: a first bolt element and a second bolt element, and the gripping arrangement is between the bolt elements.

15. The device according to claim 1, characterised in that the gripping arrangement is detachable and the body is configured in such a way that the gripping arrangement can be fixed to extend from the second side of the body.

16. The device according to claim 1, characterised in that the device is configured to be fixed onto the scope rail in two positions: a first position where the first side is on the right side of the firearm and a second position where the first side is on the left side of the firearm.

* * * * *